US010741379B2

(12) United States Patent
Zhang et al.

(10) Patent No.: US 10,741,379 B2
(45) Date of Patent: Aug. 11, 2020

(54) MASS SPECTROMETER, ION OPTICAL DEVICE, AND METHOD FOR ION MANIPULATION IN MASS SPECTROMETER USING TRAP WITH CONCENTRIC RING ELECTRODES

(71) Applicant: SHIMADZU CORPORATION, Kyoto (JP)

(72) Inventors: Xiaoqiang Zhang, Shanghai (CN); Wenjian Sun, Shanghai (CN)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 16/095,442

(22) PCT Filed: Feb. 8, 2017

(86) PCT No.: PCT/JP2017/004612

§ 371 (c)(1),
(2) Date: Oct. 22, 2018

(87) PCT Pub. No.: WO2018/020712

PCT Pub. Date: Feb. 1, 2018

(65) Prior Publication Data

US 2019/0080896 A1 Mar. 14, 2019

(30) Foreign Application Priority Data

Jul. 28, 2016 (CN) ..... 2016 1 0602789

(51) Int. Cl.
*H01J 49/42* (2006.01)
*H01J 49/06* (2006.01)

(52) U.S. Cl.
CPC ..... *H01J 49/4235* (2013.01); *H01J 49/065* (2013.01); *H01J 49/423* (2013.01);
(Continued)

(58) Field of Classification Search
None
See application file for complete search history.

(56) References Cited

U.S. PATENT DOCUMENTS 6,770,872 B2 8/2004 Bateman et al.
7,208,726 B2 4/2007 Hidalgo et al.
(Continued)

FOREIGN PATENT DOCUMENTS

CN 101632148 A 1/2010
CN 105264637 A 1/2016
(Continued)

OTHER PUBLICATIONS

Bollen, "Ion surfing" with radiofrequency carpets, 299 International Journal of Mass Spectrometry 131-138 (Jan. 15, 2011) (Year: 2011).*

(Continued)

*Primary Examiner* — James Choi
(74) *Attorney, Agent, or Firm* — Tim Tingkang Xia, Esq.; Locke Lord LLP

(57) ABSTRACT

The invention provides a mass spectrometer, an ion optical device, and a method for ion manipulation in a mass spectrometer. The mass spectrometer includes a mass analyzer; and an ion guiding device, including two electrode arrays positioned in parallel with each other, each electrode array including at least two ring electrodes concentrically disposed or at least three linear electrode assemblies having a radial distribution; and a power supply means, configured to apply a voltage on at least a part of the ring electrodes, to form a radio-frequency electric field and a DC electric field. By means of the radio-frequency electric field and the DC electric field, ions are allowed to be stored in a region between the two arrays, and controlled to be sequentially released along a radial direction according to a preset
(Continued)

mass-to-charge ratio requirement, then exit the ion guiding device and enter the mass analyzer for mass analysis.

15 Claims, 7 Drawing Sheets

(52) U.S. Cl.
CPC ..... *H01J 49/427* (2013.01); *H01J 49/4255* (2013.01); *H01J 49/4295* (2013.01)

(56) References Cited

U.S. PATENT DOCUMENTS

| | | | | |
|---|---|---|---|---|
| 7,208,728 | B2 | 4/2007 | Hashimoto et al. | |
| 7,329,862 | B2 | 2/2008 | Hashimoto et al. | |
| 7,456,388 | B2 | 11/2008 | Loboda et al. | |
| 7,714,279 | B2 | 5/2010 | Franzen | |
| 7,888,635 | B2 | 2/2011 | Belov et al. | |
| 2008/0210859 | A1* | 9/2008 | Tolley ..... | H01J 49/4235 250/282 |
| 2010/0243886 | A1 | 9/2010 | Flory et al. | |
| 2013/0105681 | A1* | 5/2013 | Kovtoun ..... | H01J 49/0481 250/282 |
| 2014/0299761 | A1 | 10/2014 | Giles | |

FOREIGN PATENT DOCUMENTS

| | | | |
|---|---|---|---|
| CN | 105470094 | A | 4/2016 |
| WO | 2007125354 | A2 | 11/2007 |
| WO | 2015189539 | A1 | 12/2015 |

OTHER PUBLICATIONS

Scott A. McLuckey, Selective Ion Isolation/Rejection Over a Broad Mass Range in the Quadrupole Ion Trap, 2 J. Am. Soc. Mass Spectom. 11-21 (1991) (Year: 1991).*

Austin, Daniel E., "Halo Ion Trap Mass Spectrometer", Anal. Chem., 2007, 79 (7), pp. 2927-2932.

EPO (ISR/EP), "International Search Report for PCT/JP2017/004612", NL, Apr. 26, 2017.

SIPO, "Chinese Office Action and Search Report for CN Application No. 2016106027897", China, Nov. 12, 2018.

* cited by examiner

MASS SPECTROMETER, ION OPTICAL DEVICE, AND METHOD FOR ION MANIPULATION IN MASS SPECTROMETER USING TRAP WITH CONCENTRIC RING ELECTRODES

TECHNICAL FIELD OF THE INVENTION

The present invention relates to the technical field of mass analysis, and particularly to a mass spectrometer, an ion optical device, and a method for ion manipulation in a mass spectrometer.

BACKGROUND OF THE INVENTION

A quadrupole-orthogonal time-of-flight (TOF) mass spectrometer typically operates in a mode in which ions generated from an ion source pass through a series of vacuum ports and ion guiding devices, and enter a quadrupole mass analyzer for mass selection. The selected parent ions enter a collision cell and are disassociated, to produce many daughter ions. The daughter ions enter a pulsed acceleration region before a flight chamber, and are orthogonally accelerated. Due to different flight times of the ions, a high-resolution and high-precision mass spectrum is generated. Wherein, the quadrupole mass spectrometer generally continuously operates in a scan mode, and the TOF mass spectrometer operates in a pulse mode. If the ions before the TOF mass spectrometer are not modulated in any way, for the pulse voltage in the acceleration region before the flight chamber, a next pulse can be generated only after the ions with the largest m/z ratios reach the detector. However, the ions enter the acceleration region continuously. As a result, the duty cycle that the ions are used by the TOF mass spectrometer is too low, thus causing the ion loss. If the distance from an electrode in the acceleration region to the detector is D, and an effective width of the electrode in the acceleration region is Δl (which may be deemed as a width of the ion beam that is accelerated before the acceleration region and forms a mass spectrum finally on the detector, and generally smaller than the actual width of the acceleration electrode), the maximum ion utilization efficiency (or referred to as duty cycle) of the instrument is related with m/z ratio of the ions:

$$\text{Duty cycle}\left(\frac{m}{2}\right) = \frac{\Delta 1}{D}\sqrt{\frac{m/z}{(m/z)_{max}}} \tag{1}$$

where $(m/z)_{max}$ is an upper limit of the mass range. In most orthogonal TOF mass spectrometers, the duty cycle ranges from about 5% to 30%. If an ion gate or ion trap is used, although the ions can impulsively enter the pulsed acceleration region before the TOF mass spectrometer, the ions experience a flight process before entering the acceleration region, therefore the ions of different m/z ratios are broadly distributed, and only ions of a certain range of m/z ratios can reach the acceleration region substantially at the same time. Therefore, the mass range is greatly limited.

Efforts are made to try to solve the problem in the prior art. For example, in U.S. Pat. No. 6,770,872 or 7,208,726, a three-dimensional ion trap is positioned before the TOF acceleration region, such that the ion trap and the TOF mass spectrometer operate cooperatively. In U.S. Pat. No. 7,714,279, a radio-frequency guiding device is used to store and release ions, ions with a small m/z ratio are released initially, and the pulse acceleration voltage is synchronized with the released ions by adjusting the parameters of a following device. In Patent No. WO2007/125354, a radio-frequency potential barrier is formed in a stacked-ring electrode array arranged along an axial direction, and the sequential release of ions according to the m/z ratios can be achieved by changing the balance between a traveling wave voltage or DC voltage along the axial direction and the radio-frequency potential barrier. In U.S. Pat. Nos. 7,208,728 and 7,329,862, two linear ion traps are disposed along the axial direction, one is for resonant excitation in the axial direction to selectively eject ions out, and the other is only for synchronization with a pulse acceleration voltage, rather than for mass selection. In this way, a duty cycle of more than 60% is obtained. The most effective and simple solution at present may be a device called "Zeno trap" proposed in U.S. Pat. No. 7,456,388, in which ions are sequentially ejected in an order of m/z ratios from largest to smallest by shifting the balance between the radio-frequency potential barrier and the DC potential barrier at the end of the device in an axial direction. The released ions are accelerated along the axial direction to have a low energy (20-50 eV), ions with a large m/z ratio have a low speed, and thus are gradually caught up by ions with a small m/z. By adjusting the speed of the released ions, ions of different m/z ratios can reach the acceleration region before the flight chamber substantially at the same time. In this manner, a duty cycle of nearly 100% can be obtained.

However, the above solutions still have problems. For example, as is known to those skilled in the art, for the Zeno trap, after the ions are released along the axial direction by overcoming the potential barrier, a long period of time is needed to cool in the radial direction, or otherwise, it is difficult to attain a high resolution of the TOF mass spectrometer. Therefore, the scanning frequency of the Zeno trap is generally about 1 kHz, which is much slower than a common pulse acceleration frequency (5-10 kHz). Accordingly, a quite high storage capacity is needed for obtaining a high ion utilization efficiency at a low scanning speed. However, the storage capacity of the Zeno trap is not higher than that of a common linear ion trap, that is, not higher than an order of magnitude of $10^5$. As such, the dynamic range of the instrument is heavily limited. The ion storage capacity can be enhanced to some extent by extending the length of the Zeno trap. However, this will lead to a bulky instrument on one hand, and a large amount of ions are broadly distributed in the axial direction on the other hand. Therefore, an extended period of time is needed for release, whereby the scanning speed of the instrument is further reduced.

Therefore, there is a need for an improved technical solution to solve the above problems.

SUMMARY OF THE INVENTION

In view of the disadvantages existing in the prior art, an objective of the present invention is to provide a mass spectrometer, an ion optical device, and a method for ion manipulation in a mass spectrometer, to solve the problem of incompatibility between the ion utilization efficiency and the volume of the mass spectrometer existing in the prior art.

To achieve the above and other relevant objectives, the present invention provides a mass spectrometer, including a mass analyzer. The mass spectrometer includes an ion guiding device, including two ring electrode arrays that are positioned in parallel with each other, each of the ring electrode arrays consisting of at least two sets of ring electrodes that are concentrically disposed, a direction pointing from the ring electrode to a ring center being defined as a radial direction, and a direction perpendicular to a plane of the ring electrode being defined as an axial direction; and a power supply means, configured to apply a voltage on at least a part of the ring electrodes to form a radio-frequency electric field and a DC electric field. By means of the radio-frequency electric field and the DC electric field, ions are allowed to implement in sequence, in a region between the two arrays, the motions of (1) the ions being guided to enter the region along the axial direction and stored in the region; (2) the ions in the region being driven to move along the radial direction by the DC electric field, and the radio-frequency electric field generating a radio-frequency potential barrier to block the ions moving along the radial direction; (3) the ions being sequentially released along the radial direction in an order of the mass-to-charge ratios from largest to smallest, by scanning the amplitude of the radio-frequency electric field or the DC electric field; and (4) the released ions being allowed to exit the ion guiding device along the axial direction, and to enter the mass analyzer for mass analysis.

In an embodiment of the present invention, each of the ring electrode arrays consists of at least three ring electrodes that are concentrically disposed.

In an embodiment of the present invention, the mass analyzer operates in a pulse mode, and an ion extraction region is disposed at a stage before the mass analyzer; and the released ions of different mass-to-charge ratios have substantially the same kinetic energy along the axial direction, and reach the ion extraction region substantially at the same time.

In an embodiment of the present invention, the mass analyzer is a TOF mass analyzer, and an ion optical lens is disposed at a stage after the ion guiding device for adjusting the ion beam of the ions of different mass-to-charge ratios exiting the ion guiding device.

In an embodiment of the present invention, the type of the mass analyzer includes quadrupole; and the released ions of different mass-to-charge ratios enter the mass analyzer along the axial direction, and a scanning voltage of the mass analyzer is synchronized according to the mass-to-charge ratios of the released ions.

In an embodiment of the present invention, the gas pressure in the ion guiding device is 0.002-0.05 Pa, 0.02-0.5 Pa, 0.2-5 Pa, 2-50 Pa, or 20-500 Pa.

In an embodiment of the present invention, the mass spectrometer includes a quadrupole mass analyzer and a collision cell located at a stage before the ion guiding device.

In an embodiment of the present invention, the ions enter or exit the ion guiding device along the axial direction at a position that is the center of the ring electrodes in one set of the ring electrode arrays.

In an embodiment of the present invention, the ions enter or exit the ion guiding device along the axial direction at a position that is between two adjacent ring electrodes in one set of the ring electrode arrays.

In an embodiment of the present invention, the region where the ions are stored is located between the two ring electrode arrays, and the stored ions are distributed annularly.

To achieve the above and other relevant objectives, the present invention provides a mass spectrometer, including a mass analyzer. The mass spectrometer includes an ion guiding device, including two ring electrode arrays that are positioned in parallel with each other, each of the ring electrode arrays consisting of at least two ring electrodes that are concentrically disposed, a direction pointing from the ring electrode to a ring center being defined as a radial direction, and a direction perpendicular to a plane of the ring electrode being defined as an axial direction; and a power supply means, configured to apply a voltage on at least a part of the ring electrodes, to form a radio-frequency electric field and a DC electric field. By means of the radio-frequency electric field and the DC electric field, ions are allowed to implement in sequence, in a region between the two arrays, the motions of (1) the ions being guided to enter the region along the axial direction and stored in the region; (2) the ions of different mass-to-charge ratios being selectively excited along the radial direction under the action of an alternating voltage, or being sequentially excited along the radial direction according to the mass-to-charge ratios, and the excited ions being allowed to approach a position at the center of the ring electrode along the radial direction; and (3) the excited ions being allowed to exit the ion guiding device along the axial direction and to enter the mass analyzer for mass analysis.

In an embodiment of the present invention, each of the ring electrode arrays consists of at least three ring electrodes that are concentrically disposed.

In an embodiment of the present invention, during exciting the ions, the radio-frequency electric field formed with a radio-frequency voltage is an approximate quadrupole field.

In an embodiment of the present invention, during the process of exciting the ions, the DC electric field formed by a DC voltage has a quadratic field distribution along the radial direction.

To achieve the above and other relevant objectives, the present invention provides a mass spectrometer, including a mass analyzer. The mass spectrometer includes an ion guiding device ion guiding device, including two sets of electrode arrays that are positioned in parallel with each other, each set of the electrode arrays consisting of at least three linear electrode assemblies that have a radial distribution, a direction of extension of the linear electrode assembly being defined as a radial direction, a direction perpendicular to a plane of each electrode array being defined as an axial direction, and each of the electrode assemblies consisting of multiple segmented electrodes along the radial direction; and a power supply means, configured to apply a voltage on at least a part of the segmented electrodes to form a radio-frequency electric field and a DC electric field. By means of the radio-frequency electric field and the DC electric field, ions are allowed to implement in sequence, in a region between the two arrays, the motions of: (1) the ions being guided to enter the region along the axial direction and stored in the region; (2) the ions being selectively released according to the mass-to-charge ratios or being sequentially released along the radial direction in an order of the mass-to-charge ratios from largest to smallest, by scanning the amplitude of a radio-frequency voltage or a DC voltage; and (3) the released ions being allowed to exit the ion guiding device along the axial direction at a position approaching the center of the electrode array having a radial distribution and to enter the mass analyzer.

To achieve the above and other relevant objectives, the present invention provides an ion optical device, configured to implement at least transport, storage, cooling, ejection, mass analysis, and ion beam compression of ions. The ion optical device includes two sets of ring electrode arrays that are positioned in parallel with each other, each set of the ring electrode arrays consisting of at least two ring electrodes that are concentrically disposed, a direction pointing from the ring electrode to a ring center being defined as a radial direction, and a direction perpendicular to a plane of the ring electrode being defined as an axial direction. A DC voltage is applied to the ring electrodes of the two sets of ring electrode arrays to form a DC electric field, a radio-frequency voltage is applied to at least a part of the ring electrodes in at least one set of the ring electrode arrays, and the radio-frequency voltages on adjacent ring electrodes have equal amplitudes and reverse phases to form a radio-frequency electric field.

In an embodiment of the present invention, by means of the radio-frequency electric field and the DC electric field, the ion optical device allows ions to implement in sequence, in a region between the two arrays, the motions of: (1) the ions being guided to enter the region between the two arrays along the axial direction and stored in the region; (2) the ions in the region being driven to move along the radial direction by the DC electric field, and the radio-frequency electric field generating a radio-frequency potential barrier to block the ions moving along the radial direction; (3) the ions being sequentially released along the radial direction in an order of the mass-to-charge ratios from largest to smallest, by scanning the amplitude of the radio-frequency electric field or the DC electric field; and (4) the released ions being allowed to exit the ion guiding device along the axial direction, and to enter the mass analyzer for mass analysis.

In an embodiment of the present invention, each of the ring electrode arrays consists of at least three ring electrodes that are concentrically disposed.

In an embodiment of the present invention, at least one ring electrode in each set of the ring electrode arrays provides a DC potential barrier to confine the ions in the radial direction, and the radio-frequency electric field provides a radio-frequency potential barrier to confine the ions in the axial direction.

In an embodiment of the present invention, a DC voltage bias is applied between the two ring electrode arrays, to drive the ions to approach a surface of one of the ring electrode arrays, and a radio-frequency potential barrier is provided at the surface of the array, to offset the DC voltage bias, thus confining the ions.

To achieve the above and other relevant objectives, the present invention provides a method for ion manipulation in a mass spectrometer, including: providing an ion guiding device, including two ring electrode arrays that are positioned in parallel with each other, each of the ring electrode arrays consisting of at least two ring electrodes that are concentrically disposed, a direction pointing from the ring electrode to a ring center being defined as a radial direction, and a direction perpendicular to a plane of the ring electrode being defined as an axial direction; and providing a power supply means, configured to apply a voltage on at least a part of the ring electrodes to form a radio-frequency electric field and a DC electric field. By means of the radio-frequency electric field and the DC electric field, ions are allowed to undergo in sequence, in a region between the two arrays, the motions of (1) the ions being guided to enter the region along the axial direction and stored in the region; (2) the ions being selectively released according to the mass-to-charge ratios or being sequentially released along the radial direction in an order of the mass-to-charge ratios from largest to smallest, by scanning the amplitude of the radio-frequency electric field or the DC electric field; and (3) the released ions being allowed to exit the ion guiding device along the axial direction and to enter the mass analyzer for mass analysis.

In an embodiment of the present invention, each of the ring electrode arrays consists of at least three ring electrodes that are concentrically disposed.

In an embodiment of the present invention, the mass analyzer operates in a pulse mode, and an ion extraction region is disposed at a stage before the mass analyzer; and the released ions of different mass-to-charge ratios have substantially the same kinetic energy along the axial direction, and reach the ion extraction region substantially at the same time.

In an embodiment of the present invention, the type of the mass analyzer includes quadrupole; and the released ions of different mass-to-charge ratios enter the mass analyzer along the axial direction, and a scanning voltage of the mass analyzer is synchronized according to the mass-to-charge ratios of the released ions.

In an embodiment of the present invention, the mass analyzer is a TOF mass analyzer, and an ion optical lens is disposed at a stage after the ion guiding device for adjusting the ion beam of the ions of different mass-to-charge ratios exiting the ion guiding device.

As described above, the present invention provides a mass spectrometer, including a mass analyzer. The mass spectrometer further includes an ion guiding device, including two sets of electrode arrays that are positioned in parallel with each other, each of the ring electrode arrays consisting of at least two ring electrodes that are concentrically disposed or at least three linear electrode assemblies that have a radial distribution; and a power supply means, configured to apply a voltage on at least a part of the ring electrodes, to form a radio-frequency electric field and a DC electric field. By means of the radio-frequency electric field and the DC electric field, ions are allowed to be stored in a region of between the two arrays, and controlled to be sequentially released along the radial direction according to a preset mass-to-charge ratio requirement, and then exit the ion guiding device and enter the mass analyzer for mass analysis.

Compared with the prior art, the present invention has the following advantages. (1) Nearly 100% ion utilization efficiency (duty cycle) can be provided over a wide mass range in tandem mass spectrometry, thus increasing the sensitivity of the instrument. (2) The ion guiding device of the present invention has a large ion storage capacity, thus ensuring a wide dynamic range of the instrument. (3) The electrodes in the ion guiding device of the present invention are distributed along the radial direction, and cause substantially no increase in the length along a major axis of the instrument, thus facilitating the miniaturization of the instrument.

BRIEF DESCRIPTION OF THE DRAWINGS

FIG. 5(*b*) is a sectional diagram along the axial direction.

DETAILED DESCRIPTION OF THE INVENTION

Hereinafter, embodiments of the present invention are described by way of specific examples. Other advantages and effects of the present invention are apparent to those skilled in the art from the disclosure herein.

Referring to accompanying drawings of the present invention, it should be known that the structures, scales, and dimensions etc depicted therein are provided merely for ease of understanding and reading the disclosure herein by persons of skill in the art, and are not restrictions to embodiment of the present invention, thus having no technically substantive significance. Any modifications to the structure, changes of the proportional relations, or adjustment of the dimensions fall within the scope covered by the disclosure herein, without affecting the efficacy and objectives that can be achieved in the present invention. Further, the terms "on", "under", "left", "right", "middle", and "a/an" as used herein are presented merely for ease of description, instead of limiting the scope of the present invention. The change or adjustment of relative position relations made without essentially altering the technical solution is contemplated in the scope of the present invention.

Figure 1:
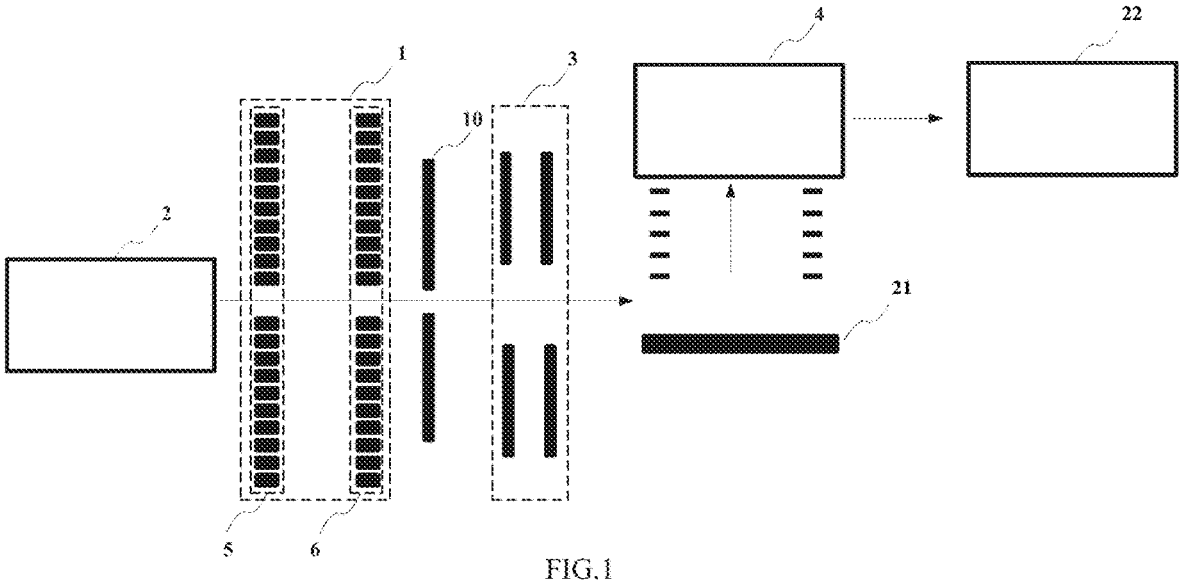
FIG. 1 is a schematic structural diagram of a mass spectrometer in a first embodiment of the present invention.

FIG. 1 shows partial structure of a mass spectrometer in a first embodiment of the present invention. In the figure, 1 is an ion guiding device described in the present invention, and 2 is a preceding device upstream of the ion guiding device 1. The preceding device 2 can provide ions entering the ion guiding device 1. For example, the preceding device 2 may feed, via a vacuum port and other ion guiding devices, ions generated from an ion source to a quadrupole for mass selection. The selected parent ions enter a collision cell and are fragmented and disassociated therein to generate many daughter ions. The daughter ions enter the ion guiding device 1. In this example, the ion guiding device 1 includes two sets of ring electrode arrays 5 and 6 that are positioned in parallel with each other, and each ring electrode array 5 or 6 consists of multiple ring electrodes that are concentrically disposed (preferably, but not limited to, the annular ring shown in the figure). A direction pointing from the ring electrode to a ring center is defined as a radial direction, and a direction perpendicular to a plane of the ring electrode is defined as an axial direction.

Figure 2:
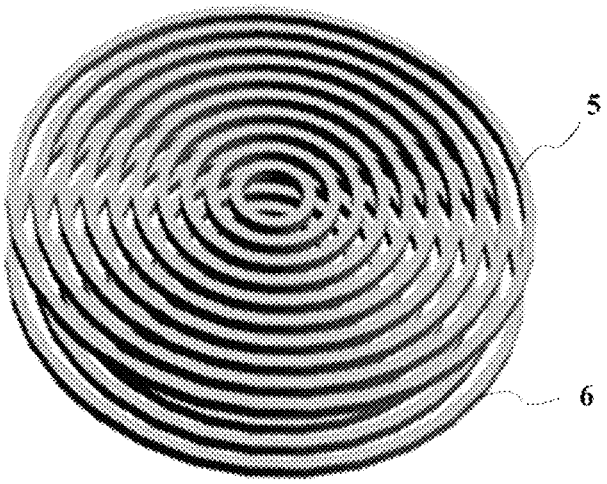
FIG. 2 is a schematic three-dimensional diagram of a ion guiding device in the first embodiment of the present invention.

FIG. 2 shows a schematic three-dimensional diagram of the ion guiding device 1. A voltage is applied to each ring electrode in the ring electrode arrays of the ion guiding device 1, to form a DC electric field and a radio-frequency electric field, whereby guiding, storage, mass selection, ejection, and other manipulations are performed on the ions, which willed be described in detail hereinafter. The ions are allowed to be ejected out along the axial direction of the ion guiding device 1, preferably at a position at the center of the ring electrode array 6. The ejected ions are, for example, collimated by a set of optical lenses 3 in FIG. 1 to adjust the ion beam, then enter an ion extraction region 21 which is preferably a pulsed acceleration region, and then are pulse accelerated, and enter a mass analyzer 4 and a following device 22 for mass spectrometry. The following device 22 is preferably an orthogonal TOF mass spectrometer including a flight tube, a reflectron, a detector, and other components.

Figure 3:
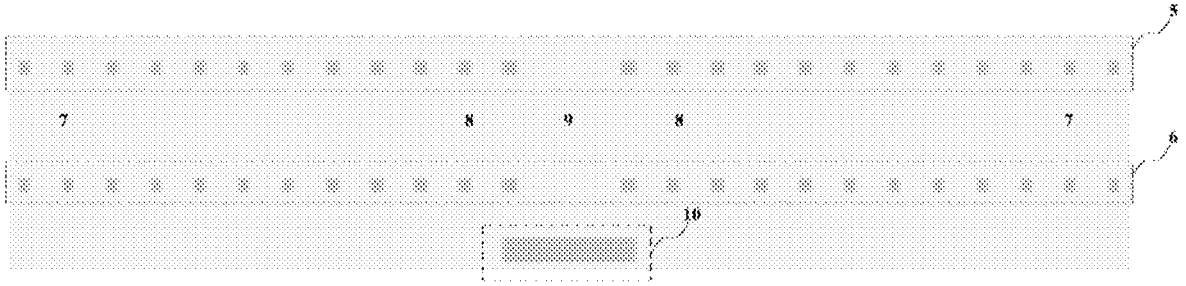
FIG. 3 is a schematic sectional diagram of the ion guiding device in the first embodiment of the present invention along a radial direction.

FIG. 3 is a schematic sectional diagram of the ion guiding device 1 of the present invention along the radial direction. In the figure, 5 and 6 are the ring electrode arrays, 10 is an ion extraction electrode of the ion guiding device 1, 7 is a region located between the ring electrode arrays 5 and 6 and close to a lateral side, 8 is a region close to a medial side, and 9 is a central region of the device.

A process for ion manipulation will be described below with positive ions as an example.

Figure 4:
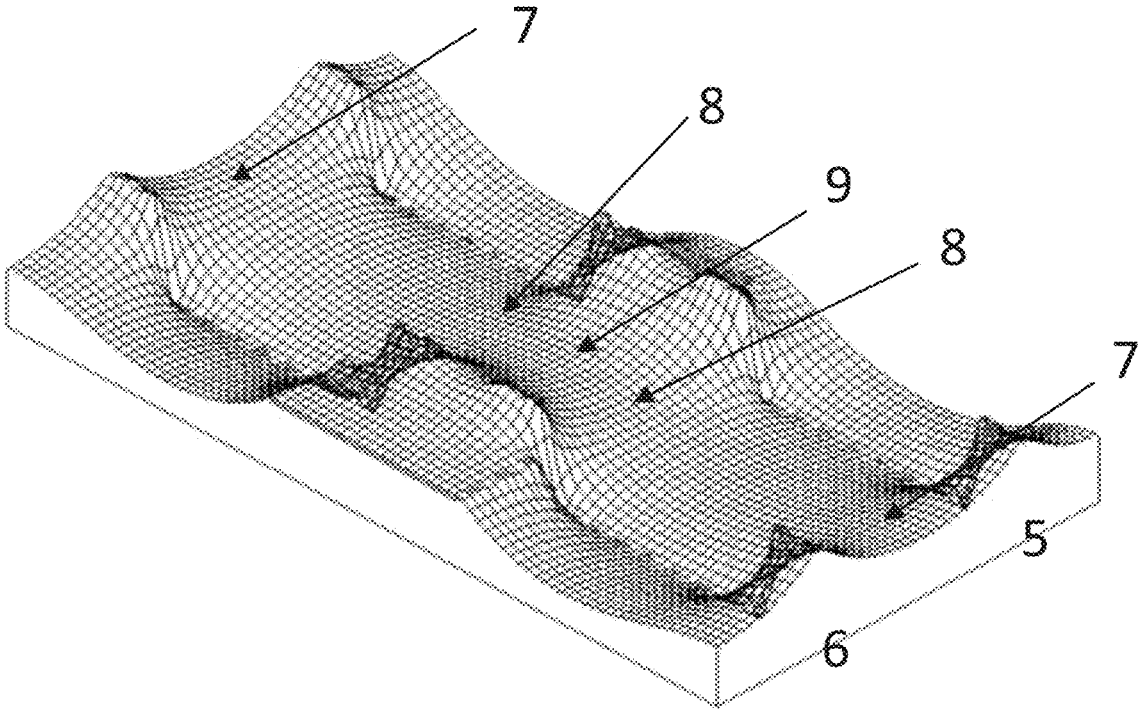
FIG. 4 is a schematic diagram of a DC potential surface in the ion guiding device when ions are stored in the ion guiding device in the first embodiment of the present invention.
Figure 5:
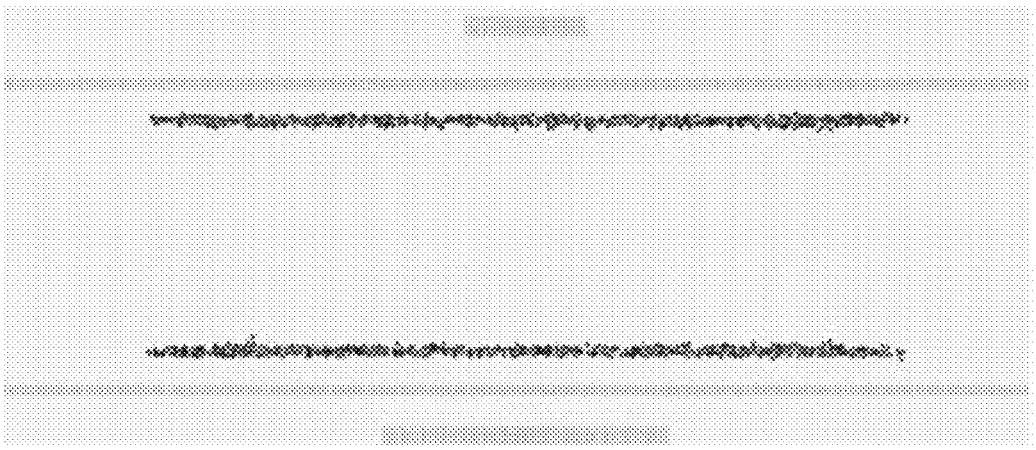
FIGS. 5(*a*) and (*b*) are schematic diagrams showing ion cloud distributions when ions are stored in the ion guiding device in the first embodiment of the present invention, wherein, FIG. 5(*a*) is a sectional diagram along the radial direction.
Figure 5:
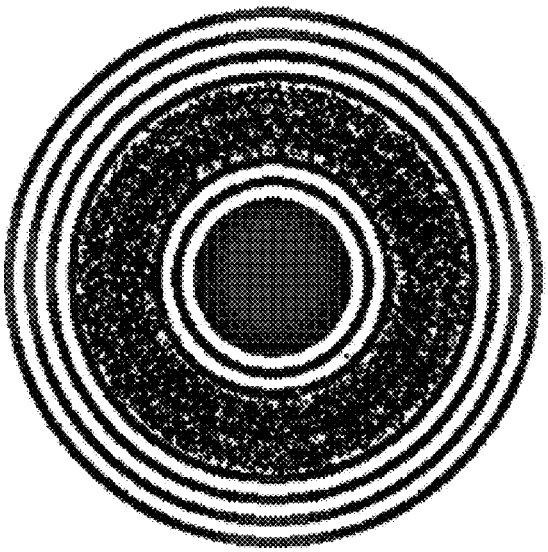

(1) Ion introduction and storage—Upon introduction, the ions enter the region between the ring electrode arrays 5 and 6 along the axial direction. This situation is simple, and can be achieved by applying a voltage that is set at a low DC potential to the whole ion guiding device 1 and applying a radio-frequency voltage. After introduction, the ions need to be stored in the region between 5 and 6. To realize high-capacity ion storage, the DC potential in the regions 7 and 8 may be elevated during ion introduction, the DC potential in a region between 7 and 8 is lowered, and the region 9 may have a DC potential equivalent to or slightly higher than that in the region 8, such that a DC potential trap is formed between the regions 7 and 8 for storing the ions. In this case, the ion guiding device 1 has a DC potential surface as shown in FIG. 4. The DC potential trap is used to confine the ions in the radial direction. A radio-frequency voltage is applied at the same time to confine the ions in the axial direction. The radio-frequency voltage is applied by applying radio-frequency voltages that have equal amplitude and reverse phases to two adjacent concentric ring electrodes. The radio-frequency electric field can form an "RF repelling force" on the surface of the ring electrode arrays 5 and 6, to prevent the ions from approaching the surface of the electrodes. Under a high gas pressure, the maximum average effective RF repelling force may be approximately expressed as:

$$F_{max} = -\frac{1}{4} m K^2 \frac{V_{RF}^2}{d^3} \tag{2}$$

where m is a mass number of the ions, K is the ion mobility, $V_{RF}$ is an amplitude of the radio-frequency voltage, and d is a distance between adjacent ring electrodes. It can be seen from Formula (2) that the radio-frequency potential barrier formed with the "RF repelling force" correlates with the mass number (or m/z) of the ions. FIGS. 5(*a*)

and (*b*) show distributions of an ion cloud formed with $5*10^7$ $C_{60}^+$ ions stored in the ion guiding device 1 by the simulation software Simion, in which the space charge effect is taken into account. During simulation, the practically input number of ions is 5000, the charge factor is 10000, and the dimensions used are 50 mm (radial direction)*15 mm (axial direction). It should be appreciated by those skilled in the art that the storage of ions with an order of magnitude of $10^7$ is difficult. A common linear ion trap has only an ion storage capacity with an order of magnitude of $10^5$. The "ion funnel trap" in for example U.S. Pat. No. 7,888,635 needs a very long length in the axial direction to achieve an order of magnitude of $10^7$. In contrast, the storage of ions with an order of magnitude of $10^7$ can be achieved with a quite short dimension (15 mm) in the axial direction in the apparatus of the present invention. Moreover, the ion storage capacity may be further expanded, for example, by increasing the number of the ring electrodes, decreasing the distance between the electrodes, or improving the radio-frequency voltage.

Figure 6:
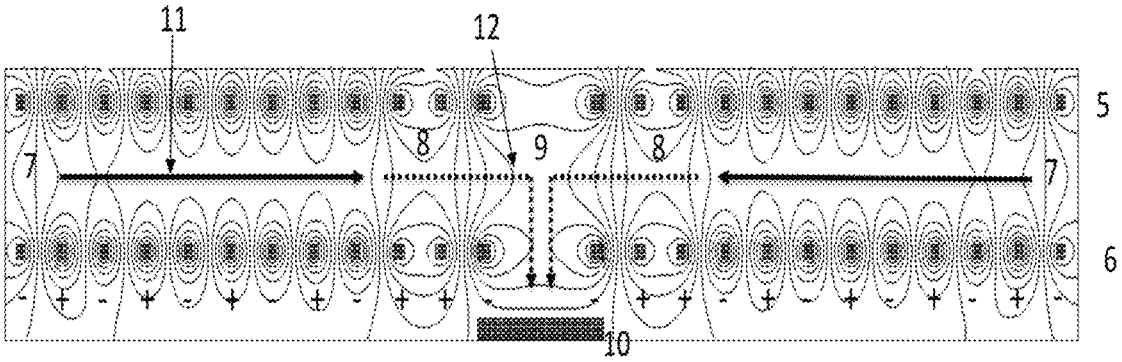
FIG. 6 is a schematic diagram showing distribution of radio-frequency electric field lines when ions are ejected out of the ion guiding device in an order of the m/z ratios from largest to smallest in the first embodiment of the present invention.

(2) The ions are sequentially released according to the m/z ratios. As shown in FIG. 6, the stored ions are driven by the DC voltage to move along the radial direction toward the region 9, that is, move along the direction of a solid arrow 11 in the figure. Before the ions move to the region 8, the radio-frequency potential barrier in the region 8 is increased. The radio-frequency potential barrier may be increased (or decreased) through many methods, for example, by altering the radio-frequency amplitude in the region, or changing the distance between the electrodes, or by using the method as shown in FIG. 6. FIG. 6 shows distribution of radio-frequency electric field lines on a section of the device 1 along the radial direction. In the figure, "+" and "−" represent reverse phases of the radio-frequency voltages having equal amplitude. Except for in the region 8, the phases of the radio-frequency voltages on adjacent ring electrodes are reverse. The phases of radio-frequency voltages on the two adjacent electrodes in the region 8 are the same (both are "+"). Through such an arrangement, a higher radio-frequency potential barrier is generated in the region 8. The ions are driven by the DC electric field to move to the region 8, and then blocked by the higher radio-frequency potential barrier. The radio-frequency potential barrier is related with m/z. The smaller the m/z (or mass number) is, the higher the potential barrier is. Therefore, when the height of the radio-frequency potential barrier is lowered, ions of a large m/z will be initially released from the region 8 by overcoming the potential barrier, and then ejected out of the device along the direction of an arrow 12. The height of the radio-frequency potential barrier is scanned gradually, to allow the ions to be released from the region 8 along the radial direction in an order of the m/z ratios from largest to smallest. The height of the radio-frequency potential barrier may be changed through many methods, for example, by changing the amplitude and frequency etc. Besides scanning the radio-frequency potential barrier, the amplitude of the driving DC electric field may also be scanned, to achieve the sequential release of ions in an order of the m/z ratios from largest to smallest. Moreover, in the present invention, the ion manipulation is carried out in a large region that is centrally symmetric along the radial direction, thereby effectively avoiding the space charge effect and reducing the length of the instrument.

It should be noted that the arrow 12 in the figure is a broken line, that is to say, the ions are deflected after being released along the radial direction, and then exit the device 1 along the axial direction. The deflection can be realized simply by adjusting the distribution of the DC electric field in the region 9, as is known to those skilled in the art.

In the two sets of ring electrode arrays constituting the ion guiding device 1, each array contains at least two electrodes, to form the radio-frequency potential barrier or DC drive. In this case, the device may be regarded as a linear ion trap connected head to tail. The existing technical solutions of all the linear ion traps are applicable to this device. However, the preferred solution is one formed with three or more electrodes, to obtain an additional ion storage region, thereby effectively overcoming the space charge effect.

In the ion guiding device 1, gas of a certain pressure is preferably filled, to rapidly cooling the ejected ions through collision with the background gas molecules in the device 1. The cooling process can be accomplished under the action of the radio-frequency electric field. However, the cooling process may also take place outside of the ion guiding device 1. Therefore, the ion guiding device 1 is suitable for use under various gas pressures, ranging from 0.002-0.05 Pa, 0.02-0.5 Pa, 0.2-5 Pa, 2-50 Pa, or 20-500 Pa.

Preferably, the ions enter the ion guiding device 1 along the axial direction at a position at the center of the ring electrode array 5, and exit at a position at the center of the ring electrode array 6. However, the present invention is not limited thereto. For example, the ions may enter the ion guiding device 1 at a position located between two adjacent ring electrodes in the ring electrode array 5, and exit the ion guiding device 1 at a position located between two adjacent ring electrodes in the ring electrode array 6. The entering or exiting ion beam may be a single or multiple beams, and may have an arrangement along the radial direction.

Figure 7:
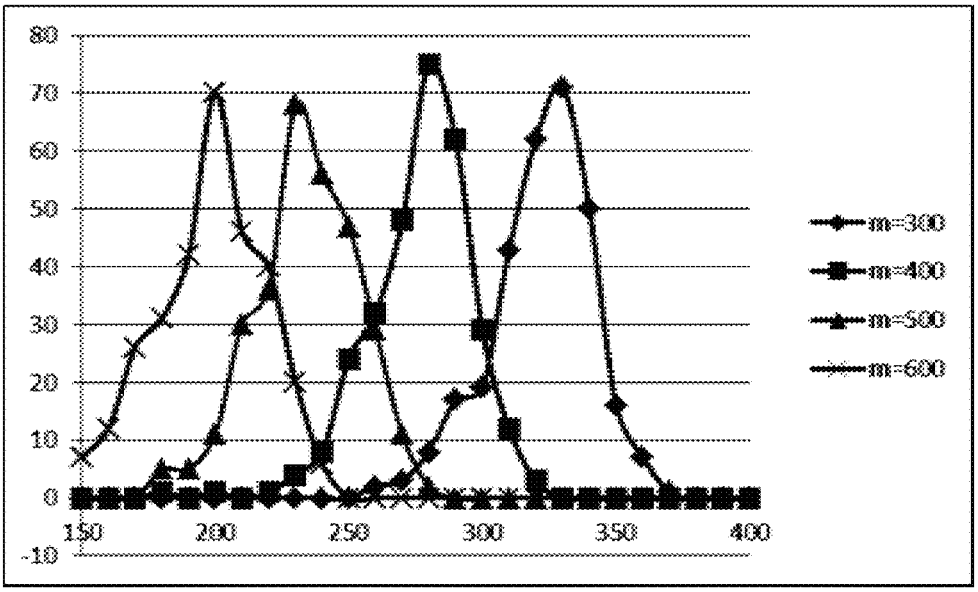
FIG. 7 is a schematic diagram showing preliminary results of computer simulation obtained from mass selection in the ion guiding device in the first embodiment of the present invention.

FIG. 7 shows preliminary results of simulation obtained from mass selection in the ion guiding device 1 by using the software Simion under a high gas pressure (10 Pa). In the figure, the horizontal axis is the time when the ions reach the extraction electrode 10, and the longitudinal axis is the ionic strength. It can be seen from the figure that the separation of ions differing in mass number by a factor of about 1.5 can be realized, and a higher mass resolution can be achieved if the gas pressure is further reduced. However, the mass resolution shown in the embodiment is adequate for the problem intended to be solved in the present invention.

Through the present invention, the problem of low ion utilization efficiency in the quadrupole-orthogonal TOF mass spectrometry as described in the background can be addressed. As shown in FIG. 1, the ions released from the ion guiding device 1 in an order of the m/z ratios from largest to smallest are initially fully cooled through collision, to obtain an ion beam having essentially exclusively energy of thermal motion. Although the cooling process may restrain the scanning speed of the ion guiding device 1, all the ions generated in the preceding device 2 can still be processed at a low scanning speed because the ion guiding device 1 has a quite large ion storage capacity. In contrast, the apparatus in U.S. Pat. No. 7,456,388 will necessarily suffer from a large ion loss, thus being failed to guarantee a high sensitivity and a wide dynamic range. The ions cooled in the ion guiding device 1 are adjusted with the optical lens 3 and accelerated along the axial direction to have a low energy (generally in the range of 20-50 eV). The following processes are similar to those in U.S. Pat. No. 7,456,388. Ions of different m/z ratios have substantially the same energy in the axial direction, and thus the ions with a large m/z ratio have a low speed in the axial direction. By adjusting the speed of ions released from the ion guiding device 1, ions with a small m/z ratios that are released later but have a high speed in the axial direction are allowed to catch up, and reach the ion extraction region 21 preceding the mass analyzer 4 substantially at the same time with ions with a large m/z ratios. Almost all the ions can be ensured to enter the following device 7 (that is, the orthogonal-TOF mass spectrometer) at the same time for mass analysis, with no need to require the ion guiding device 1 to have a high mass resolution, and the ion utilization efficiency (or duty cycle of the TOF mass spectrometer) is nearly 100%. It should be noted that the ion guiding device 1 also operates in a pulse mode, and the pulse duty cycle may be synchronous with the pulse acceleration voltage of the TOF mass spectrometer. Accordingly, the preceding device 2 of the ion guiding device 1 generally also needs to have an ion gate, so as to impulsively introduce the ions into the ion guiding device 1.

Figure 8:
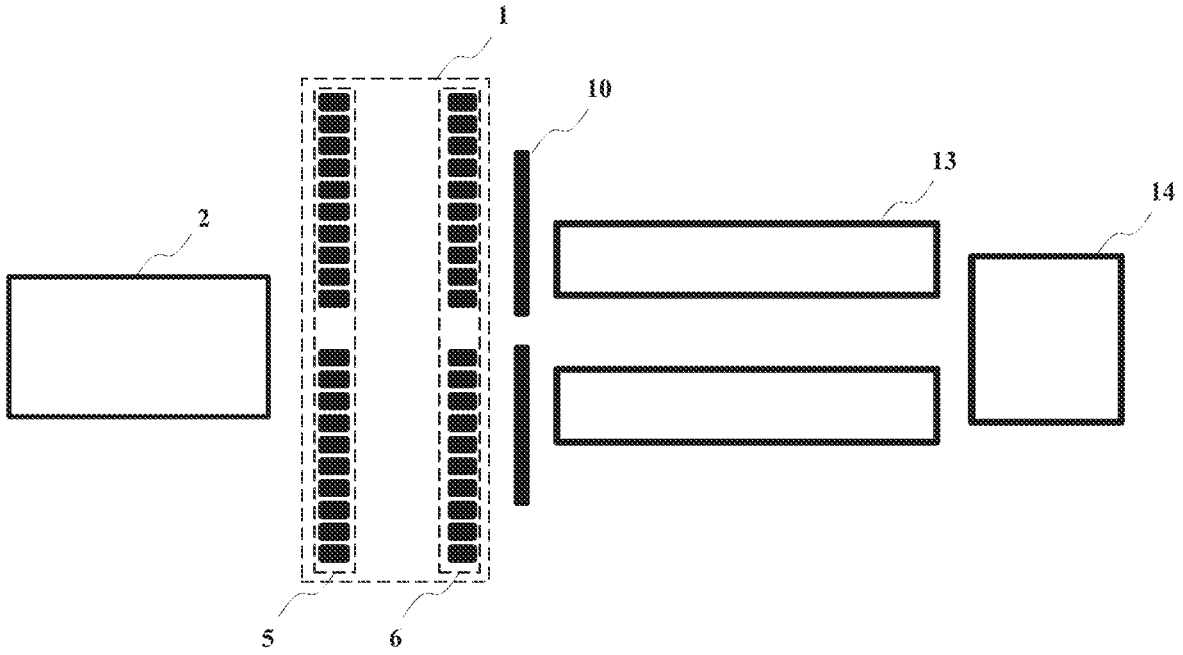
FIG. 8 is a schematic structural diagram of the ion guiding device and a quadrupole mass analyzer used in coordination in the first embodiment of the present invention.

Through the present invention, the problem of low duty cycle in the quadrupole mass analyzer as described in the background can also be addressed. FIG. 8 is a schematic diagram of the ion guiding device 1 and a quadrupole mass analyzer 13 used cooperatively. Compared with FIG. 1, the preceding device 2 and the ion guiding device 1 are unchanged, but the following mass analyzer 13 is a quadrupole, and a following device 14 after the quadrupole may be a detector or an additional mass analyzer. The ion guiding device 1 operates in a mode as described above. The ions are sequentially ejected out along the axial direction in an order of the m/z ratios from largest to smallest, and the scanning voltage of the mass analyzer 13 is synchronized according to the m/z ratios of the ejected ions. The so-called synchronization means that when ions of a certain m/z ratio or a certain range of m/z ratios enter the mass analyzer 13, the radio-frequency voltage and DC voltage of the mass analyzer 13 are analyzed, such that only ions of the m/z ratio or the range of m/z ratios are allowed to pass through. That is, the amplitude of the radio-frequency/DC voltage in the mass analyzer 13 is accordingly scanned from largest to smallest. In this way, a nearly 100% duty cycle is obtained.

In the present invention, the method for mass selection by using the ion guiding device 1 is not limited to one as described above, and other methods may also be used. For example, excitation with an alternating voltage can be used. As shown in FIG. 4, after the ions are stored in the ion guiding device 1 for a period of time, an alternating voltage may be applied along the radial direction of the ion guiding device 1 on basis of the radio-frequency voltage and DC voltage. The alternating voltage is an excitation voltage, and typically has a frequency proportional to that of the radio-frequency voltage. With a certain amplitude of the alternating voltage, ions of a particular m/z ratios are resonated with the excitation voltage, and thus ejected out. Another way of excitation may also be used, in which the DC electric field of the ion guiding device 1 has a quadratic field distribution along the radial direction, and the alternating voltage along the radial direction is used as an excitation voltage for mass selection. Compared with the sequential release of ions in an order of the m/z ratios from largest to lowest, the mass selection by excitation is more flexible. For example, in a triple quadrupole, where a multiple reaction monitoring (MRM) mode is employed, the ion guiding device 1 is positioned before Q1 (that is, stage 1 mass analysis quadrupole) of the triple quadrupole, and rough screening of the mass is conducted according to the m/z ratios of the mother ions in each channel, such that the duty cycle of each channel can reach 100%. Therefore, the ion guiding device 1 has a great advantage. Where a product ion scan mode is employed, the ion guiding device 1 is positioned after Q2 (that is, the collision cell), and the order of release of m/z ratios from the ion guiding device 1 is synchronized with the scanning voltage of Q3 (that is, stage 2 mass analysis quadrupole), to obtain a daughter ion utilization efficiency of 100%. Excitation with an alternating voltage also allows the ion guiding device 1 to have better performances, for example, higher mass resolution and higher scanning speed. These distinctions are familiar to those skilled in the art of ion trap or quadrupole, and thus will not be further described here again.

Figure 9:
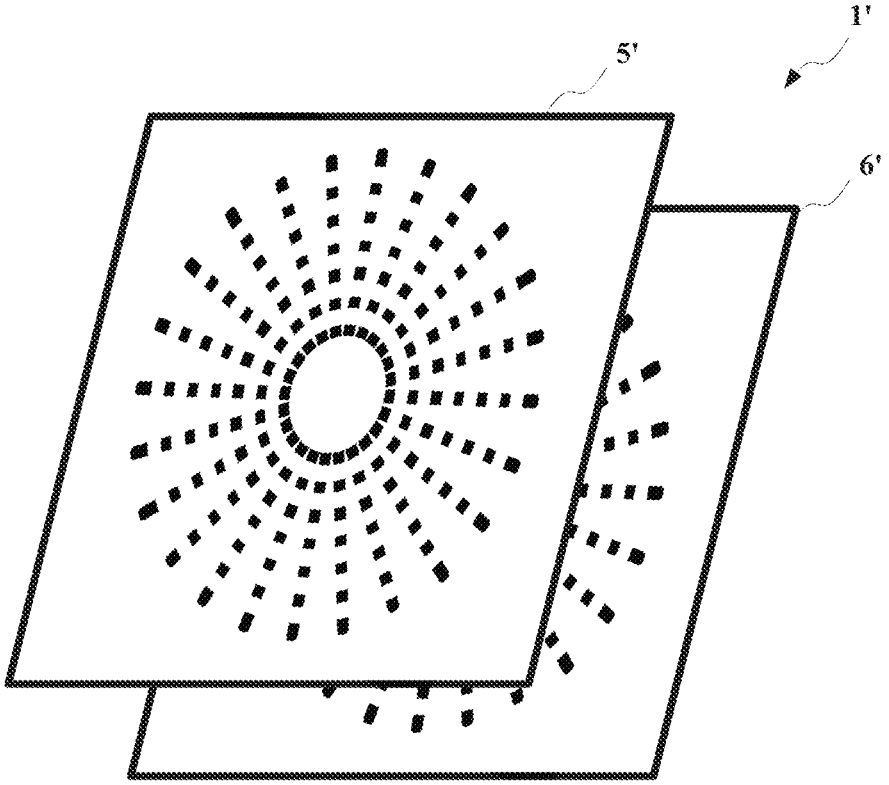
FIG. 9(*a*) is a schematic structural diagram of a ion guiding device in a second embodiment of the present invention, and FIG. 9(*b*) is a schematic sectional diagram of an electrode array of the ion guiding device in the second embodiment of the present invention along a radial direction.
Figure 9:
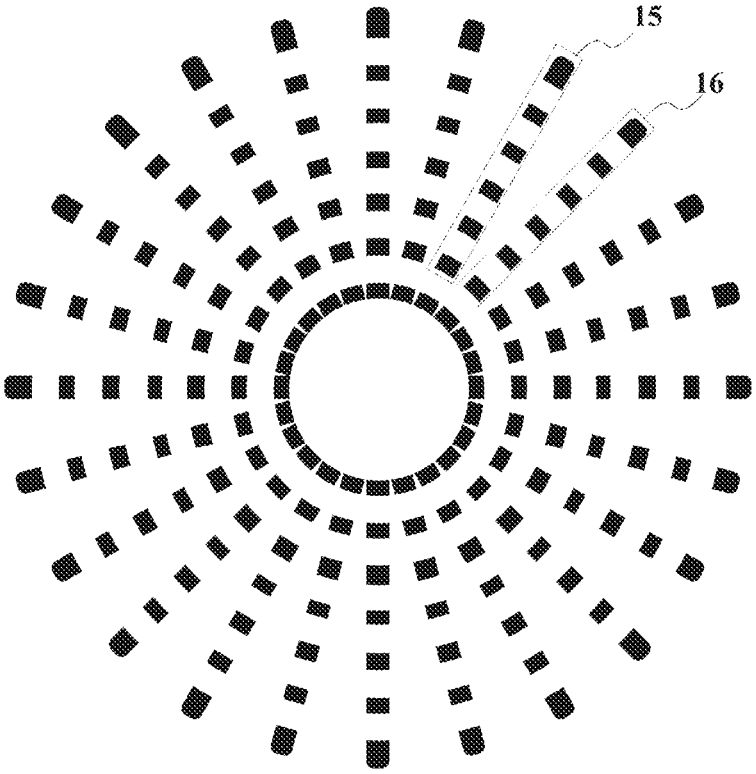

FIG. 9 illustrates a second embodiment of the present invention. In FIG. 9(*a*), an ion guiding device 1' includes two electrode arrays 5' and 6' that are positioned in parallel with each other, and each of the electrode arrays 5' or 6' consists of multiple linear electrode assemblies (for example, but not limited to, 12 in the figure) having a radial distribution. A direction of extension of the linear electrode is defined as a radial direction, and a direction perpendicular to a plane of each electrode array 5' or 6' is defined as an axial direction.

FIG. 9(*b*) is a sectional diagram of the electrode array 5' or 6' along the radial direction. In the figure, 15 and 16 are two linear electrode assemblies. Each linear electrode assembly consists of multiple (for example, but not limited to, 7 in the figure) segmented electrodes along the radial direction. A power supply means is provided, which is configured to apply a voltage to at least a part of the electrodes, to form a radio-frequency electric field and a DC electric field. By means of the radio-frequency electric field and DC electric field, ions experience in sequence, in a region between the electrode arrays 5' and 6', (1) the ions being allowed to enter the region along the axial direction and being stored in the region; (2) the ions being selectively released according to the m/z ratios, or being sequentially released along the radial direction in an order of the m/z ratios from largest to smallest, by scanning the amplitude of the radio-frequency voltage or DC voltage; and (3) the released ions being allowed to exit the ion guiding device 1' along the axial direction at a position close to the center of the electrode array 5' or 6' having a radial distribution, and to enter the mass analyzer.

Embodiment 2 differs from Embodiment 1 in that segmented electrodes along the radial direction are used (or it can be understood as the ring electrode in the embodiment 1 being segmented). This has the advantage that the voltage can be applied more flexibly. For example, the radio-frequency electric field may be formed to have a distribution similar to that in Embodiment 1 or have a multipole-type distribution.

Figure 10:
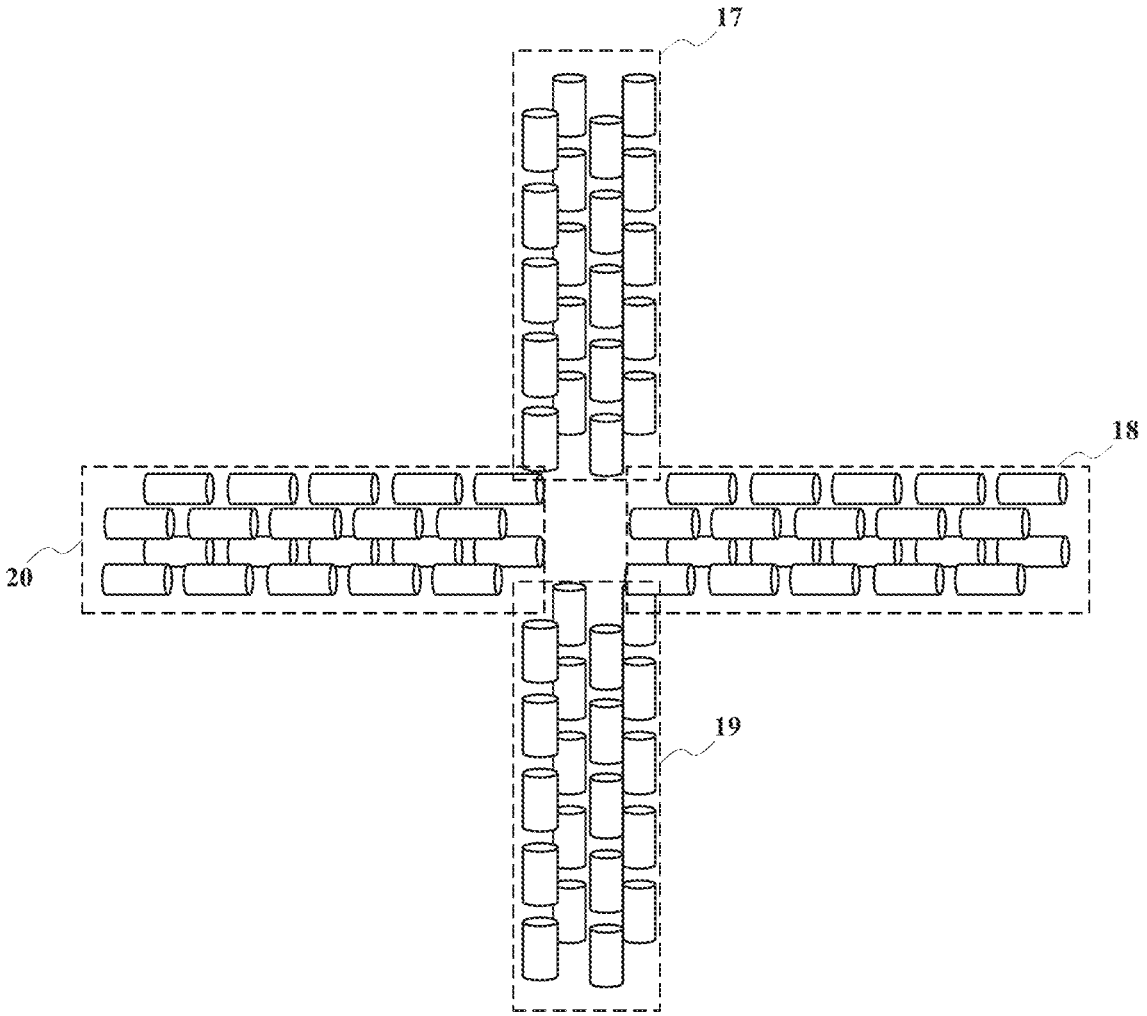
FIG. 10 is a schematic structural diagram of an another embodiment of the ion guiding device in the second embodiment of the present invention.

FIG. 10 illustrates a variation of this embodiment. An ion guiding device provided in this embodiment consists of four linear ion traps 17, 18, 19, and 20 segmented along the radial direction, and the four ion traps 17, 18, 19, and 20 have a radial distribution. When the ion guiding device 1 in FIG. 1 is replaced by the ion guiding device shown in the embodiment of FIG. 10, since the ions may be manipulated separately in the four ion traps 17, 18, 19, and 20, a high flexibility is produced. For example, the ions may be ejected out according to different m/z ratios at different times, or fragmented, disassociated, and reacted in a certain ion trap inter alia.

Compared with the prior art, the present invention has the following advantages: (1) nearly 100% ion utilization efficiency (duty cycle) can be provided in a wide mass range in tandem mass spectrometry, thus increasing the sensitivity of the instrument; (2) the ion guiding device of the present invention has a large ion storage capacity, thus ensuring a wide dynamic range of the instrument; (3) the electrodes in the ion guiding device of the present invention are distributed along the radial direction, and cause substantially no increase in the length along a major axis of the instrument, thus facilitating the miniaturization of the instrument.

The present invention is of a high industrial applicability by effectively overcoming the disadvantages existing in the prior art.

The embodiments above can be modified and changed by those skilled in the art without departing from the spirit and scope of the present invention. Therefore, equivalent modifications or changes made by persons of ordinary skill in the art without departing from the spirit and technical idea disclosed herein are covered by the claims of the present invention. The foregoing embodiments have been presented merely for purposes of exemplarily illustrating the principle and effects of the present invention, and they are not intended to limit the present invention.

What is claimed is:

1. A mass spectrometer, comprising a mass analyzer, wherein the mass spectrometer comprises:

an ion guiding device, comprising two sets of ring electrode arrays that are positioned in parallel with each other, each set of the ring electrode arrays consisting of at least two ring electrodes that are concentrically disposed, a direction pointing from the ring electrode to a ring center being defined as a radial direction, and a direction perpendicular to a plane in which the ring electrode is located being defined as an axial direction; and a power supply means, configured to apply a voltage on at least a part of the ring electrodes to form a radio-frequency electric field and a DC electric field, wherein by means of the radio-frequency electric field and the DC electric field, ions are allowed to implement in sequence, in a region between the two sets of arrays, the motions of (1) the ions being guided to enter the region along the axial direction and stored;

(2) the ions in the region being driven to move along the radial direction by the DC electric field, and the radio-frequency electric field generating a radio-frequency potential barrier to block the ions moving along the radial direction, wherein before the ions move to a first region between the two sets of ring electrode arrays adjacent to the region in the radial direction, the radio-frequency potential barrier in the first region is increased through an arrangement in which radio-frequency voltages on adjacent ring electrodes have equal amplitudes and reverse phases except for in the first region in which the radio-frequency voltages on two radially adjacent ring electrodes have same phases;

(3) the ions being sequentially released along the radial direction in an order of the mass-to-charge ratios from largest to smallest, by scanning the amplitude of the radio-frequency electric field or the DC electric field; and (4) the released ions being allowed to exit the ion guiding device along the axial direction, and to enter the mass analyzer for mass analysis.

2. The mass spectrometer according to claim 1, wherein the each set of the ring electrode arrays consists of at least three ring electrodes that are concentrically disposed.

3. The mass spectrometer according to claim 1, wherein the mass analyzer operates in a pulse mode, and an ion extraction region is disposed at a stage before the mass analyzer; and the released ions of different mass-to-charge ratios have substantially the same kinetic energy along the axial direction, and reach the ion extraction region substantially at the same time.

4. The mass spectrometer according to claim 3, wherein the mass analyzer is a time-of-flight (TOF) mass analyzer, and an ion optical lens is disposed at a stage after the ion guiding device for adjusting the ion beam of the ions of different mass-to-charge ratios exiting the ion guiding device.

5. The mass spectrometer according to claim 1, wherein the type of the mass analyzer comprises: quadrupole; and the released ions of different mass-to-charge ratios enter along the axial direction of the mass analyzer, and a scanning voltage of the mass analyzer is synchronized according to the mass-to-charge ratio of the released ions.

6. The mass spectrometer according to claim 1, wherein the gas pressure in the ion guiding device is 0.002-0.05 Pa, 0.02-0.5 Pa, 0.2-5 Pa, 2-50 Pa, or 20-500 Pa.

7. The mass spectrometer according to claim 1, comprising a quadrupole mass analyzer and a collision cell located at a stage before the ion guiding device.

8. The mass spectrometer according to claim 1, wherein the ions enter or exit the ion guiding device along the axial direction at a position that is the center of the ring electrodes in one set of the ring electrode arrays.

9. The mass spectrometer according to claim 1, wherein the ions enter or exit the ion guiding device along the axial direction at a position that is between two adjacent ring electrodes in one set of the ring electrode arrays.

10. The mass spectrometer according to claim 1, wherein the region where the ions are stored is located between the two sets of ring electrode arrays, and the stored ions are distributed annularly.

11. A method for ion manipulation in a mass spectrometer, comprising:

providing an ion guiding device, comprising two sets of ring electrode arrays that are positioned in parallel with each other, each set of the ring electrode arrays consisting of at least two ring electrodes that are concentrically disposed, a direction pointing from the ring electrode to a ring center being defined as a radial direction, and a direction perpendicular to a plane in which the ring electrode is located being defined as an axial direction; and providing a power supply means, configured to apply a voltage on at least a part of the ring electrodes to form a radio-frequency electric field and a DC electric field, wherein by means of the radio-frequency electric field and the DC electric field, ions are allowed to implement in sequence, in a region between the two arrays, the motions of (1) the ions being guided to enter the region along the axial direction and stored;

(2) the ions in the region being driven to move along the radial direction by the DC electric field, and the radio-frequency electric field generating a radio-frequency potential barrier to block the ions moving along the radial direction, wherein before the ions move to a first region between the two sets of ring electrode arrays adjacent to the region in the radial direction, the radio-frequency potential barrier in the first region is increased through an arrangement in which radio-frequency voltages on adjacent ring electrodes have equal amplitudes and reverse phases except for in the first region in which the radio-frequency voltages on two radially adjacent ring electrodes have same phases;

(3) the ions being selectively released according to the mass-to-charge ratios or being sequentially released along the radial direction in an order of the mass-to-charge ratios from largest to smallest, by scanning the amplitude of the radio-frequency electric field or the DC electric field; and (4) the released ions being allowed to exit the ion guiding device along the axial direction and to enter the mass analyzer for mass analysis.

12. The method according to claim 11, wherein each set of the ring electrode arrays consists of at least three ring electrodes that are concentrically disposed.

13. The method according to claim 11, wherein the mass analyzer operates in a pulse mode, and an ion extraction region is disposed at a stage before the mass analyzer; and the released ions of different mass-to-charge ratios have substantially the same kinetic energy along the axial direction, and reach the ion extraction region substantially at the same time.

14. The method according to claim 11, wherein the type of the mass analyzer includes: quadrupole; and the released ions of different mass-to-charge ratios enter the mass analyzer along the axial direction, and a scanning voltage of the mass analyzer is synchronized according to the mass-to-charge ratios of the released ions.

15. The method according to claim 11, wherein the mass analyzer is a time-of-flight mass analyzer, and an ion optical lens is disposed at a stage after the ion guiding device for adjusting the ion beam of the ions of different mass-to-charge ratios exiting the ion guiding device.

* * * * *